US009875614B2

(12) United States Patent
McCoy et al.

(10) Patent No.: US 9,875,614 B2
(45) Date of Patent: Jan. 23, 2018

(54) IN-GAME REWARDS BASED ON REAL WORLD LOYALTY PROGRAMS

(71) Applicants: Sony Corporation, Tokyo (JP); Sony Network Entertainment International LLC, Los Angeles, CA (US)

(72) Inventors: Charles McCoy, Coronado, CA (US); True Xiong, San Diego, CA (US); Clay Fisher, San Diego, CA (US)

(73) Assignees: SONY CORPORATION, Tokyo (JP); SONY NETWORK ENTERTAINMENT INTERNATIONAL LLC, Los Angeles, CA (US)

( * ) Notice: Subject to any disclaimer, the term of this patent is extended or adjusted under 35 U.S.C. 154(b) by 502 days.

(21) Appl. No.: 14/455,995

(22) Filed: Aug. 11, 2014

(65) Prior Publication Data

US 2016/0042607 A1 Feb. 11, 2016

(51) Int. Cl.
*G07F 17/32* (2006.01)

(52) U.S. Cl.
CPC ..... *G07F 17/3255* (2013.01)

(58) Field of Classification Search
USPC ..... 463/25
See application file for complete search history.

(56) References Cited

U.S. PATENT DOCUMENTS 8,272,945 B2 9/2012 Kelly
8,480,471 B2 7/2013 Lutnick
2012/0215637 A1 8/2012 Hermann
2012/0221399 A1* 8/2012 Aloni ..... G06Q 20/10 705/14.27
2012/0226534 A1* 9/2012 Aloni ..... G06Q 20/10 705/14.17
2013/0116032 A1* 5/2013 Lutnick ..... G07F 17/3276 463/17
2013/0116038 A1* 5/2013 Alderucci ..... G06Q 20/207 463/25
2014/0135955 A1* 5/2014 Burroughs ..... G06F 19/3481 700/91
2014/0206433 A1* 7/2014 Lutnick ..... G07F 17/3258 463/25
2014/0370958 A1* 12/2014 Lutnick ..... G07F 17/3276 463/17
2015/0294284 A1* 10/2015 Soon-Shiong ..... G06Q 30/0222 705/14.23
2016/0203675 A1* 7/2016 Lutnick ..... G07F 17/3232 463/16

* cited by examiner

*Primary Examiner* — Pierre E Elisca
(74) *Attorney, Agent, or Firm* — Mayer & Williams PC

(57) ABSTRACT

Systems and methods provided allow users to receive rewards in a videogame based on their "real world" purchases, where such purchases are those they may have made anyway, but which now provide the incentive of receiving rewards in particularly new ways. By providing a connection between a server operating the loyalty reward system and a game server or game administration server, the system can be made seamless and can closely tie the purchase to the reward. Players may receive in-game benefits based on their real world activities with loyalty programs, including rewards for purchases on credit cards, debit cards, or at particular storefronts.

28 Claims, 11 Drawing Sheets

50

IN-GAME REWARDS BASED ON REAL WORLD LOYALTY PROGRAMS

CROSS-REFERENCE TO RELATED APPLICATIONS (None.)

BACKGROUND

Credit card companies and merchants created loyalty programs to encourage customers to transact more business by tracking their customer's activities and providing rewards based on those tracked activities. An example is a return of money, e.g., "cash back", based on amount charged. Another example is an accumulation of points which may be spent on various goods. While these programs provide an incentive for customers to use their credit cards, or to frequent merchants offering such programs, rewards tend to be ad hoc and simply based on what the credit card company or storefront wishes to provide. There is a need for a more flexible system, and one which takes into account current needs of consumers. There is further a need for a system which is seamless to the user, and one that is tied more closely to the incentive.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY

Certain systems and methods according to present principles provide a solution to the problems noted above in several ways. First, users are enabled to receive rewards in a videogame based on their "real world" purchases, where such purchases are those they may have made anyway, but which now provide the incentive of receiving rewards in particularly new ways. By providing a connection between a server operating the loyalty reward system and a game server or game administration server, the system can be made seamless and can closely tie the purchase to the reward.

In certain implementations, players, also termed "purchasing users" or "purchasers" based on context, receive in-game benefits based on their real world activities with loyalty programs. The loyalty program may include rewards for purchases on credit cards, debit cards, or at particular storefronts. The loyalty program tracks transactions a customer makes, associated with a particular account.

In-game benefits may be granted automatically based on certain conditions occurring in a linked loyalty program. An example is that if a user buys a particular product in a grocery store, and swipes their grocery store loyalty card that is linked to their game account, their player character may receive a particular item in game automatically.

A loyalty reward program may be linked to a particular game, but multiple loyalty reward programs may also be linked to multiple games, and the user interface may be employed to tie particular reward programs to particular (or multiple) games. The user interface may also be employed to provide an even greater level of granularity, such as to tie particular categories of purchases to particular types of in-game benefits. For example, using a card to pay at one retailer may result in one set of in-game benefits, and using the same card to pay at a different retailer may result in a different set of in-game benefits.

Variations of the systems and methods will be understood. For example, rather than providing a known reward as a result of a purchase, the "in-game" reward may be to increase the likelihood that the purchaser's player character will receive a desirable item as a result of a "drop", e.g., when a nonplayer character is defeated. The in-game reward may be to enter the purchaser's player character into a raffle to receive an in-game item, or to receive another item or character benefit on which a degree of chance is based.

In other variations, benefits offered in game may be on a retailer-by-retailer basis or a retailer category-by-retailer category basis. For example, if a purchase is made at a particular chain of shoe stores, a player character may gain special boots in game. If the same card is used to purchase gasoline, the player character may receive other and unrelated in-game benefits, e.g., character buffs, healing items, enhancements to player character characteristics such as strength, stamina, hit points, levels, or the like.

In some implementations, in-game benefits may automatically be granted based on loyalty program activity. For example, purchasing a particular product in the real world associated with the loyalty program may cause an in-game character to automatically be given a specific item. The loyalty program may also accumulate points that a player can actively choose to spend for in-game benefits. Such points can be in a pool that is dedicated to in-game benefits or can be shared with points that may be spent for benefits other than in-game benefits. A player might receive in-game points and separate real world benefits for the same loyalty program activity. Two players may combine points from different loyalty programs to achieve a desired end, e.g., group benefits for a guild or other grouping.

In other variations, benefits to game accounts, and player characters associated with game accounts, are based on factors other than loyalty program transactions. For example, where a user has increased their own real world health or fitness, e.g., by taking part in a fitness program, the system may provide benefits to a player character associated with the user, e.g., to the player character's health, fitness, stamina, or the like. Other user activity, besides those related to health or fitness, may also provide benefits to user game accounts or player characters, but in a less correlated way. And user activity may lead to benefits other than to a health or fitness characteristic, e.g., strength or stamina, of a player character.

In a first aspect, the invention is directed towards a method for providing an in-game benefit based on a transaction associated with a loyalty program, including: receiving notification of a transaction associated with a loyalty program account; and transmitting data to a game server or a game administration server. The data includes at least: a first data component including identifying information about a game account associated with the loyalty program account; and a second data component including at least information about the transaction.

Implementations of the invention may include one or more of the following. The receiving and transmitting may be performed on a loyalty program module. The loyalty program module may be resident on an intermediate server. The loyalty program account may be associated with a game. The second data component may further include information about an in-game benefit to be associated with the game account based on the transaction. The game server or game administration server may be configured to determine an in-game benefit for the game account at least partially based on the second data component. The second data component may further include at least identifying information about a player character associated with the game account. The identifying information about a player character may include data about a player character parameter or player character inventory item to be benefited by the in-game benefit. The method may further include combining data stored at the game server or game administration server with the identifying information about a player character to result in a change to a player character parameter or player character inventory item based on the in-game benefit. The player character may be made stronger by the in-game benefit, or the player character may receive an in-game item by the in-game benefit. The second data component may further include at least identifying information about a game associated with the game account. The second data component may further include an amount of in-game currency to be associated with the game account. The transaction may be associated with more than one loyalty program. The transaction may be associated with a credit card, a debit card, or a loyalty card. The transmitting data may include transmitting data from a credit or debit card processing server. The credit card processing server may be a bank server or a merchant server. The transmitting data may include transmitting data from a server associated with a loyalty program.

In a related aspect, the invention is directed towards a non-transitory computer readable medium, including instructions for causing a computing environment to perform the above method.

In another aspect, the invention is directed towards a user interface application, the application stored on a non-transitory computer readable medium, the user interface application performing the following steps: displaying indicators of one or more loyalty programs; displaying one or more game accounts to be associated with the one or more loyalty programs; receiving a first input from a user, the first input associating one of the displayed game accounts with one of the loyalty programs; and displaying an indication of the associated game account and loyalty program.

Implementations of the invention may include one or more of the following. The application may further include receiving a second input from a user, the second input associating a player character within a game within the associated game account with the loyalty program. The application may further include receiving a third input from a user, the third input associating a parameter of the player character with the loyalty program. The parameter may be a player character characteristic or a player character inventory.

In a related aspect, the invention is directed towards a non-transitory computer readable medium, including instructions for causing a computing environment to perform the above method.

In another aspect, the invention is directed towards a method for providing an in-game benefit based on user activity, including: receiving notification of a user physical activity, the notification providing an indication of a user health or fitness parameter; and transmitting data to a game server or a game administration server, the data including at least: a first data component including identifying information about a game account; and a second data component including at least information about the indication of a user health or fitness parameter.

Implementations of the invention may include one or more of the following. The second data component may further include data about a game associated with the game account to which an in-game benefit is to be provided. The second data component may further include data about a character within the game associated with the game account to which the in-game benefit is to be provided. The in-game benefit to be associated with a player character may be correlated to the indication of a user health or fitness parameter. The in-game benefit to be associated with a player character may be uncorrelated to the indication of a user health or fitness parameter. The notification may be received from a server signally coupled to a sensor. The notification may be received from a mobile device. The receiving and transmitting may be performed on an intermediate server.

In a related aspect, the invention is directed towards a non-transitory computer readable medium, including instructions for causing a computing environment to perform the above method.

In another aspect, the invention is directed towards a method for providing an in-game benefit based on user activity, including: receiving notification of a user physical activity, the notification providing an indication of a user health or fitness parameter; and issuing a code configured to be entered to a game server or a game administration server, the code including at least a data component including information about an in-game benefit, the in-game benefit to be associated with a player character, the in-game benefit based on the indication of a user health or fitness parameter.

In another aspect, the invention is directed towards a method for providing an in-game benefit based on a transaction associated with a loyalty program, including: receiving notification of a transaction associated with a loyalty program account; and transmitting data to a game server or a game administration server, the data including at least: a first data component including identifying information about a game account associated with the loyalty program account and a second data component including at least information about the transaction; and automatically providing an in-game benefit based on the transaction.

Implementations of the invention may include one or more of the following. The in-game benefit may be automatically provided to a predetermined game within the game account. The in-game benefit may be automatically provided to a predetermined player character within the predetermined game within the game account.

In another aspect, the invention is directed towards a method for providing an in-game benefit based on a transaction associated with a loyalty program, including: receiving a signal corresponding to a notification of a transaction associated with a loyalty program; adding a number of loyalty points based on the transaction to a loyalty program account associated with the loyalty program; receiving an indication from a user of a game account on which to expend a number of loyalty points; transmitting data to a game server or a game administration server, the data including at least: a first data component including identifying information about a game account associated with the loyalty program account and a second data component including at least information about the number of points.

Implementations of the invention may include one or more of the following. The loyalty points may be associated with a game. The transmitted data may further provide data to the game server or the game administration server about an in-game benefit to be purchased with the loyalty points.

Advantages of the invention may include one or more of the following. As in-game rewards are virtual, the same can be a potentially inexpensive reward to provide (according to the economics of the game). As certain in-game items have proven in prior games to be highly desirable, providing such as rewards may be a strong driver of transaction activity for a given credit card, debit card, or storefront. Cross promotions may also be organized within the system. Users may be incentivized to follow health and fitness regimes by receiving in-game benefits based on the user performance in reaching health or fitness goals. Other advantages will be understood from the following, including the figures and claims.

This Summary is provided to introduce a selection of concepts in a simplified form. The concepts are further described in the Detailed Description section. Elements or steps other than those described in this Summary are possible, and no element or step is necessarily required. This Summary is not intended to identify key features or essential features of the claimed subject matter, nor is it intended for use as an aid in determining the scope of the claimed subject matter. The claimed subject matter is not limited to implementations that solve any or all disadvantages noted in any part of this disclosure.

BRIEF DESCRIPTION OF THE DRAWINGS

Corresponding reference characters indicate corresponding parts throughout the drawings. Elements are not to scale unless otherwise stated.

DETAILED DESCRIPTION

Figure 1:
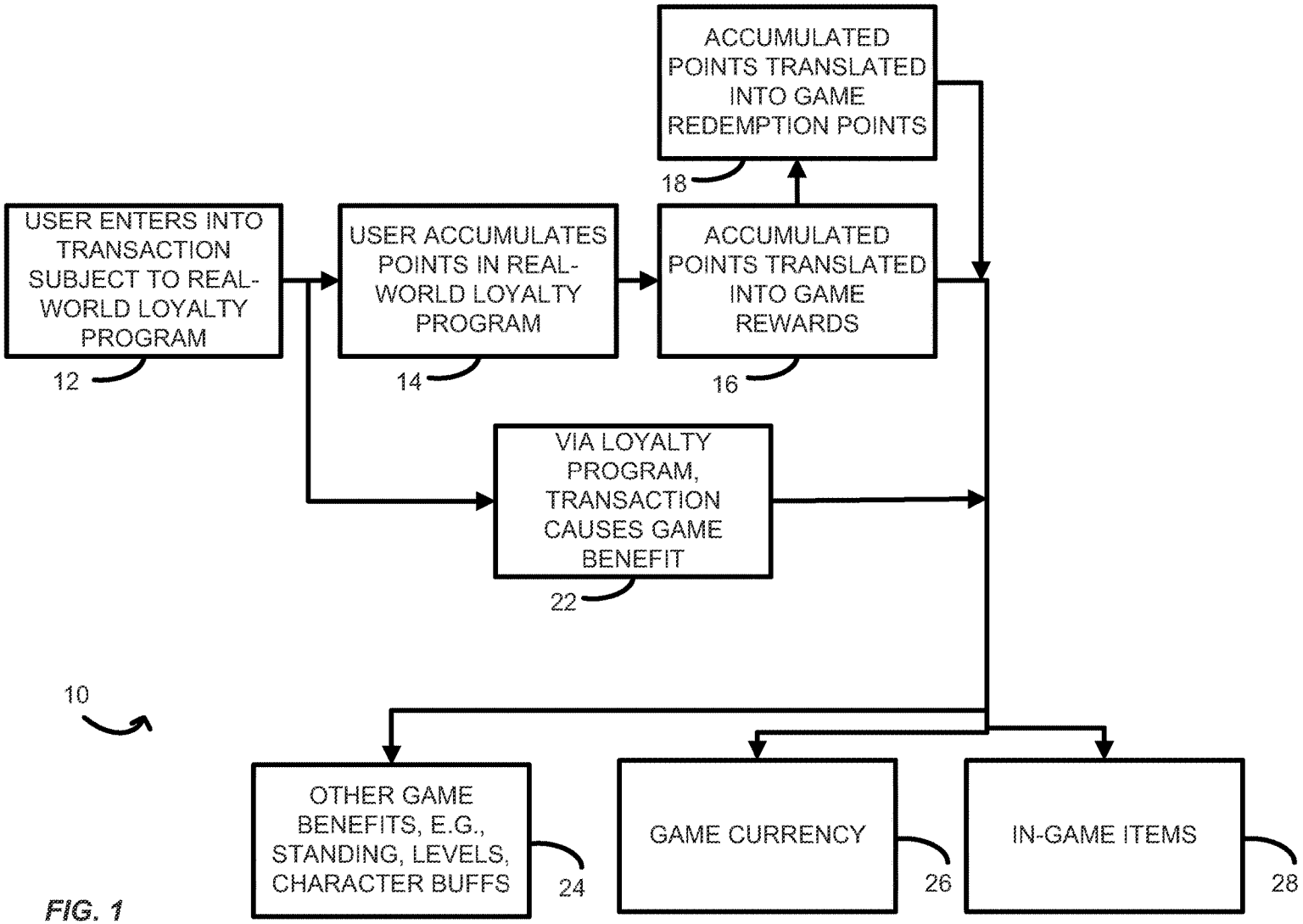
FIG. 1 is a flowchart illustrating a method according to present principles, illustrating an exemplary technique to receive in-game rewards from a "real world" purchase.

FIG. 1 illustrates an exemplary flowchart of a method 10 according to present principles. In a first step, a user enters into a transaction that is subject to a real world loyalty program (step 12). For example, a user may purchase an item using a credit or debit card, where the credit or debit card either directly provides a loyalty program (via the card's issuer) or where the credit or debit card usage is affiliated with a third-party loyalty program. For example, usage of a credit card from a first issuer may result in a benefit in a third-party loyalty program. In yet another case, a user may purchase an item using a credit or debit card, but also present to the merchant a third-party loyalty program identification, such as a loyalty card. In this case, while the presented credit or debit card does not directly result in accumulation of points or other credits in the loyalty program, the same inure to the user because of the simultaneous presentation of the separate loyalty card. In yet other cases, the user may receive benefits from both the credit card transaction (when they pay using a credit card with a loyalty program) and from swiping a loyalty card as part of the transaction.

The user then accumulates points or credits in the real world loyalty program (step 14). It will be understood that such points or credits may be in a number of forms besides points or credits, including virtual currency, the remuneration of specific items upon passing threshold levels (e.g., "earning" a specific item upon expenditure of a certain threshold number of dollars using the credit or debit card), or the like.

The accumulated points are then translated into in-game rewards (step 16). This step may be performed in a number of ways. For example, accumulated points may be translated into game redemption points (step 18), and in this way be translated into a form more adapted (or adaptable) to the game environment. Accumulated points may also be used directly, where the pricing of in-game rewards is given in terms of loyalty points.

Whether the accumulated points are translated into game rewards directly or through the intermediary of game redemption points, the same may then result to a benefit to a user within a game. The benefit to the user within a game may be to the user's user account, e.g., to allow the user to purchase other games or expansions or the like. The benefit may also be to one or more player characters associated with the user, or via any other way in which a user may benefit. Exemplary ways are described below, and include the provision of an amount of currency within a game or associated with the user account (step 26), specific in-game items for use within a game or by a specific character or characters (step 28), or other in-game benefits (step 24). For example, upon reaching a threshold in the loyalty program, a user may be enabled to advance their player character a level. Other exemplary game benefits include player character standing within groups or factions, character buffs, special inventory items, or the like.

As an alternative step to step 14, in which a user accumulates points in a real world loyalty program which are then translated into game rewards, the transaction of step 12 may directly result in a specific game benefit (step 22), with or without an intermediary step of accumulating points in a loyalty program. Such game benefits may be as noted above, e.g., providing game currency (step 26), providing in-game items (step 28), e.g., specific and desirable or rare in-game items, or providing other game benefits (step 24). Such other game benefits may include those noted above, including player character standing, e.g., within a faction or group, player character levels, player character buffs, or the like. This alternative may be particularly appropriate where real world purchases have an easily identifiable in-game analog, although this is in no way a requirement. For example, purchasing shoes at a shoe store may result in a character receiving special boots in game. Exemplary types of real world items with resulting in-game item analogs are shown below in Table I. Other types will also be understood. While real world items with in-game analogs are discussed, it should be understood that in many cases the real world item and in-game reward will not be analogous. That is, there need be no specific connection between the in-game reward and the real world activity that triggered the reward.

TABLE I

| Category | Real World Item | Resulting In-Game Item |
|---|---|---|
| Good | Vehicle | In-Game Mount |
| | Food/Drink | Character Buff |
| | Food/Drink | Health/Mana |
| | Health Club Membership | Character Buff |
| | Financial Product | In-Game Currency |
| | Real Estate | Housing/Building |
| | Food/Drink | Character Housing (or any other non-analogous item) |
| | (ANY) | (USER-SELECTION) |
| Merchant | Bank | In-Game Currency |
| | Clothing Store | Credit at In-Game Clothier or Armor Merchant |
| | Car Dealership | In-Game Mount |
| | Bank | Character Food/Drink (for health/mana) (or any other non-analogous item) |
| | (ANY) | (USER-SELECTION) |
| Transaction | Credit Card Usage | Accumulation of In-Game Credit |
| | Debit Card Usage | 'Cash' Back on Purchases (Cash as In-Game Rewards) |
| | Debit Card Usage | In-Game Mount (or any other non-analogous item) |
| | (ANY) | (USER-SELECTION) |

In yet another alternative, real world loyalty points may be directly used to purchase in-game items. That is, the same loyalty points earned by transactions may be used without conversion to purchase in-game items or other benefits as noted above, e.g., for the purchase of airline tickets, store gift cards, or other items.

Figure 2:
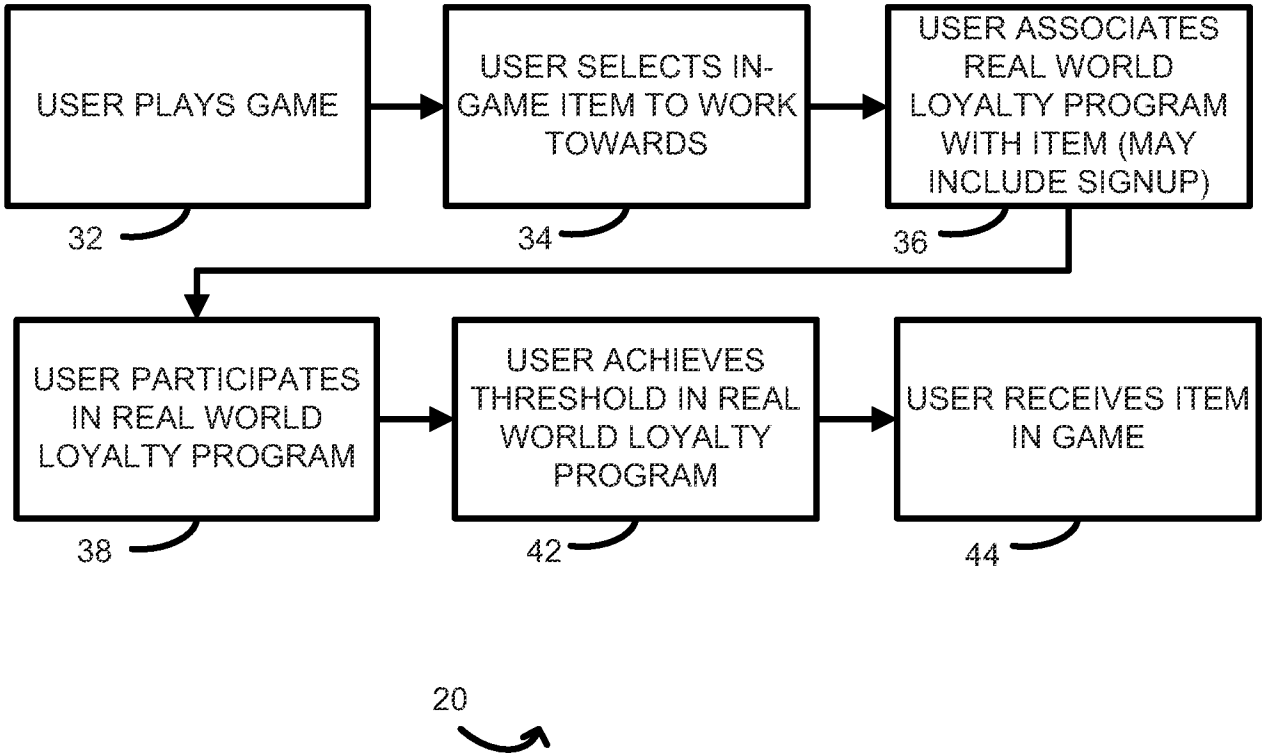
FIG. 2 is another flowchart illustrating a method according to present principles, illustrating another exemplary technique to receive in-game rewards from a "real world" purchase.

In yet another alternative, illustrated by the flowchart 20 of FIG. 2, a user may preselect an in-game item to work towards within the context of a loyalty program. In a first step, a user plays the game in which they want the benefit (step 32), and select an in-game item to work towards (step 34). In an alternative implementation, the user may select the item via an interface, not in game.

One benefit to the implementation of FIG. 2 is that certain games may provide discounts on items purchased in this way, as a benefit has been conveyed to the game owner or operator of knowing that a particular item is desired and will likely be transferred to a character in the future. While such virtual items are free to the owner/operator from the standpoint of their creation, such may impose certain costs on the economy of the system. For example, if a particularly rare in-game item were made too easily available, its value in the game environment economy would decrease, and such economic effects may have repercussions on other values.

Once the user has selected an in-game item to work towards, the user may associate a real world loyalty program with the selected item (step 36). This step may include a step of signing up with a loyalty program, if such has not already been arranged. This step may also be nominal if the user only has one real world loyalty program with which their credit cards and debit cards are associated. However, assuming there are more, this step would allow the specification or designation of a real world loyalty program to associate with the game or game item.

The user then participates in the real world loyalty program (step 38), e.g., by conducting transactions in which loyalty rewards or points are earned, e.g., by use of credit cards, debit cards, loyalty cards, or the like. Once the user achieves a threshold in the real world loyalty program (step 42), e.g., achieves the threshold necessary to obtain the selected in-game item, the user then receives the item in game (step 44). The threshold may be the same as that set at the point of step 34, or the threshold may have moved, depending on the economics of the game. Various incentives may be provided by use of a moving threshold. For example, the user may be incentivized to reach the threshold sooner if doing so allows a discount in the threshold. For example, if the user achieves the threshold within two weeks, the threshold may be lowered by 10%. Numerous variations of such incentivization programs will be understood given this teaching.

Figure 3:
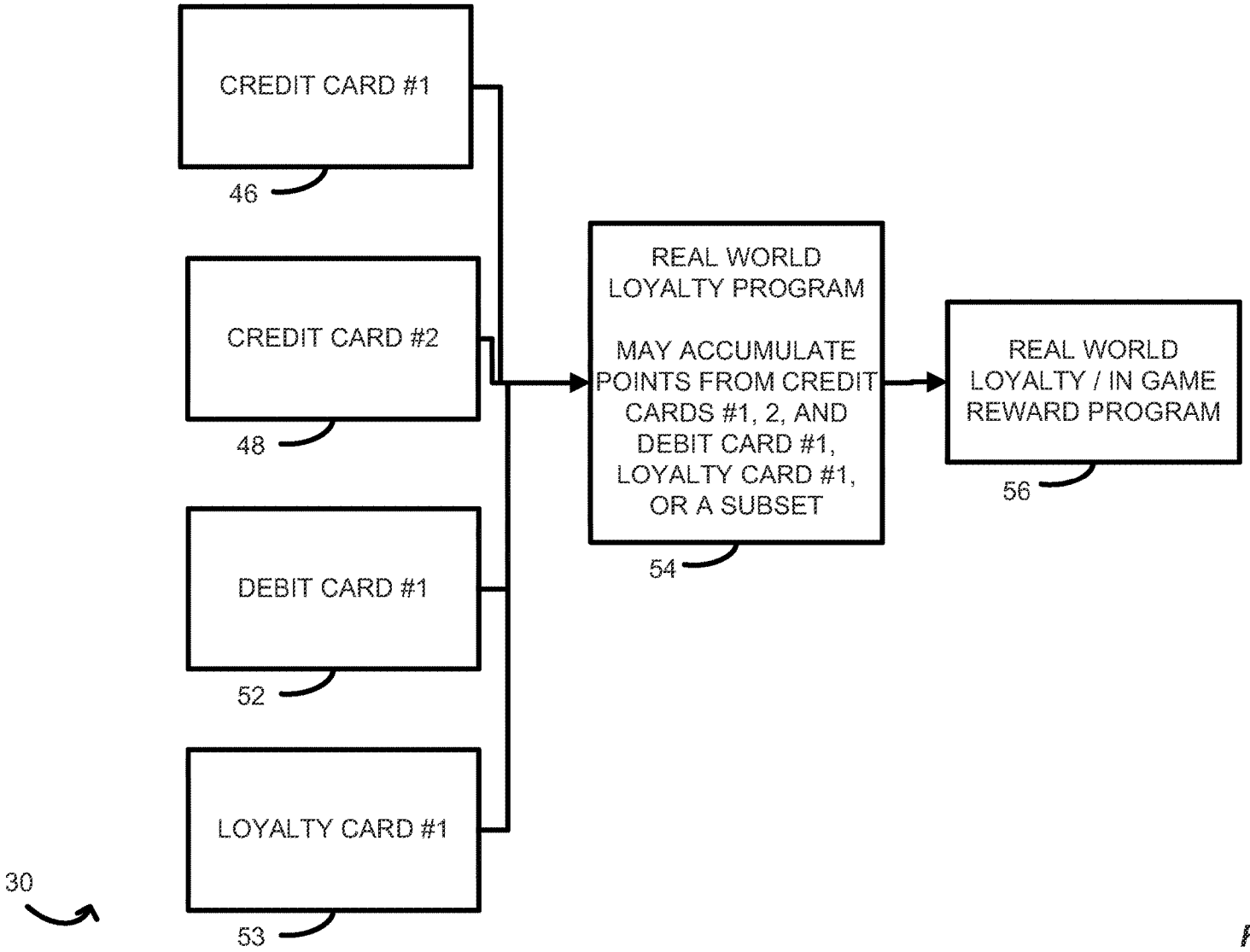
FIG. 3 is another flowchart illustrating a method according to present principles, illustrating another exemplary technique to receive in-game rewards from a "real world" purchase.

FIG. 3 is a flowchart 30 illustrating one of the methods noted above, in which multiple debit or credit cards may lead to the accumulation of points within a single loyalty program. In particular, a first credit card 46, a second credit card 48, a first debit card 52, and a first loyalty card 53, are shown linked to a real world loyalty program 54. As such, points in the real world loyalty program may be accumulated from use of all of these noted cards, or a subset of the noted cards. The points earned, or a subset, may then be employed in a real world loyalty/in-game reward program 56, for provision of in-game benefits as described above.

Figure 4:
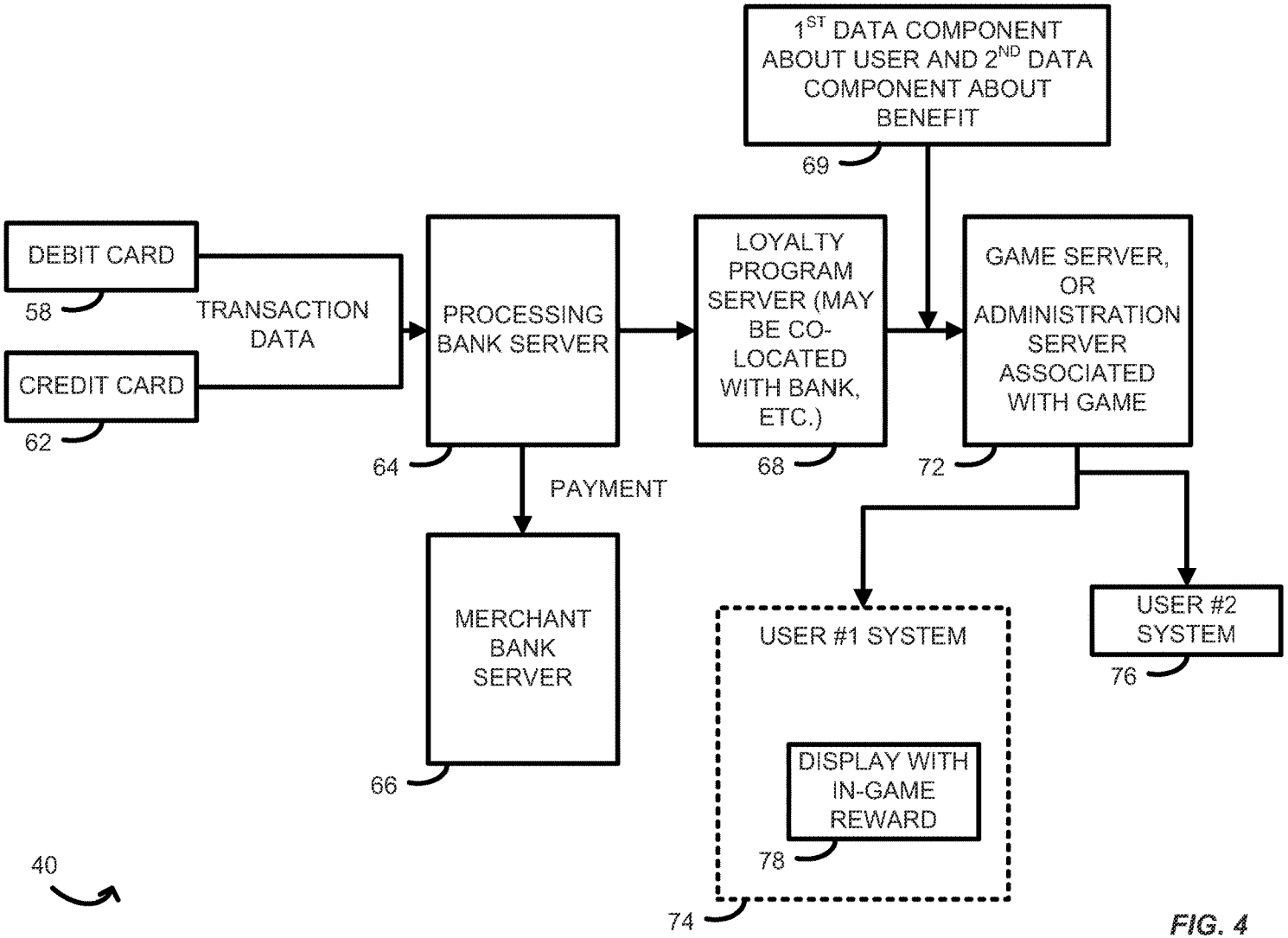
FIG. 4 is a logical diagram illustrating components in an exemplary system and method according to present principles.

FIG. 4 illustrates a logical diagram 40, in which in-game benefits inure from transactions associated with loyalty programs. In particular, use of a debit card 58 or credit card 62 to perform a transaction with a merchant causes transaction data to be sent to a processing bank server 64, which notes the transaction on a user account associated with the user and provides payment to a merchant bank server 66. The processing bank server 64 may then transmit data to provide a notification of the transaction to a loyalty program server 68, which credits a user account associated with the loyalty program accordingly. The data 69 transmitted may generally include a first data component identifying the user and a second data component providing an indication of the transaction and/or the in-game reward. Generally, the credit to the user account associated with the loyalty program is directly proportional to the amount of the transaction, but other variations are possible, simply based on a number of transactions, a nonlinear proportionality, or the like. A nonlinear proportionality may be particularly appropriate with in-game rewards, as the same as noted above are virtually cost-free to the game provider. That is, in a very specific non-limiting example, while a real world transaction of $100 may result in real world loyalty benefits of, e.g., $2-$5, in-game benefits may be significantly greater as they cost the game owner/operator much less to provide. It is also noted that the loyalty program server 68 may be co-located or the same as the processing bank server 64.

The loyalty program server 68 may then transmit data to provide a notification to a game server 72, or an administration server associated with the game. The game server or "administration server" then provides the in-game benefit to a user system. Two users systems are illustrated in FIG. 4, i.e., a first user system 74 and a second user system 76. In this example, the first user system 74 is displaying the in-game rewards 78 on a user interface, e.g., either within the game or associated with the game. In so displaying, the game server or administration server transmits a signal to the user system, causing the in-game benefit to be rendered on a display using a graphics card or integrated graphics chipset.

Figure 5:
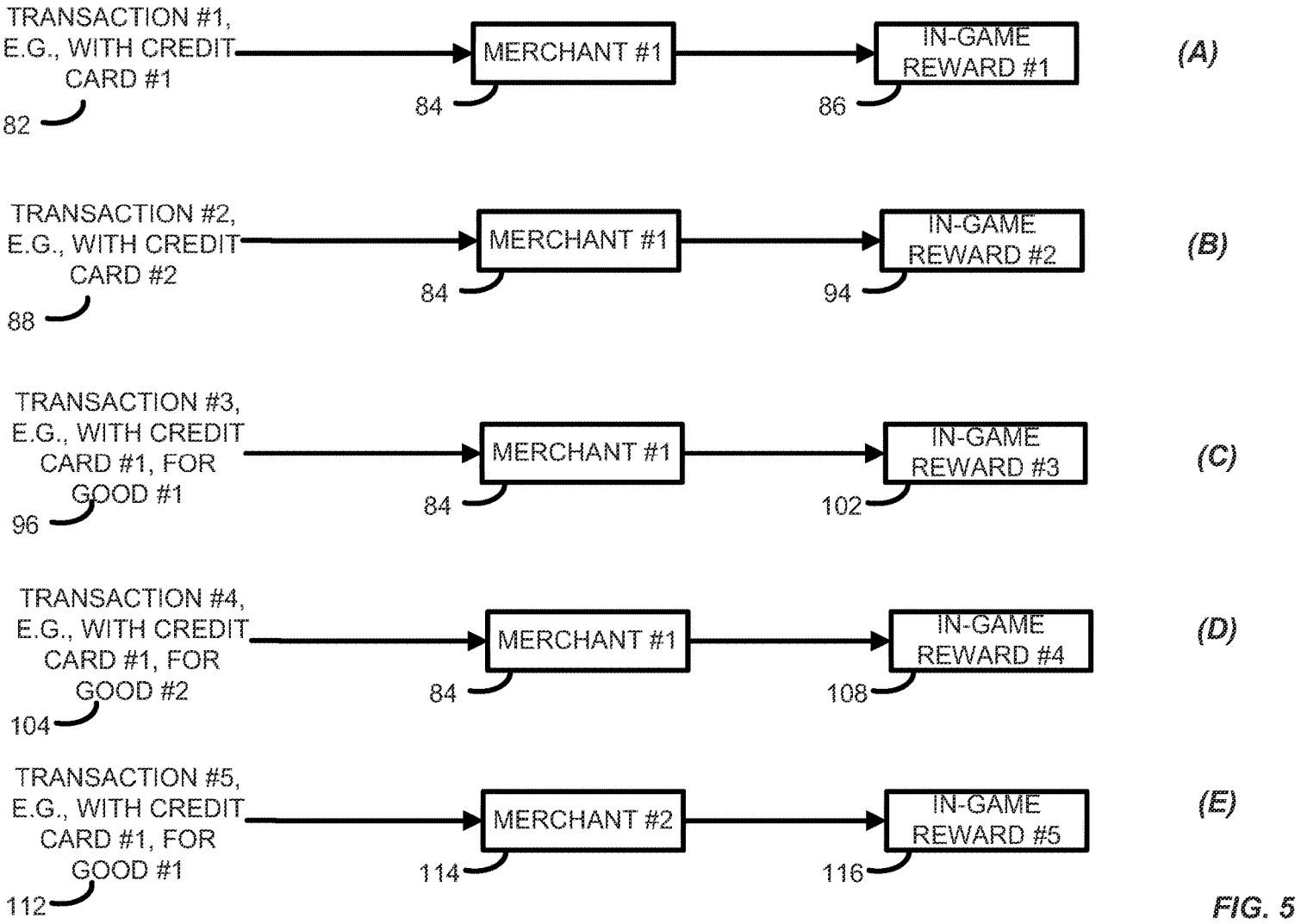
FIGS. 5(A)-5(E) illustrate types of transactions that may result in in-game rewards according to present principles.

FIGS. 5(A)-5(E) illustrate a number of different types of transactions, showing the flexibility of the system. In FIG. 5A, a transaction 82 is performed with a first credit card at a first merchant 84, and this leads to an in-game reward 86. In FIG. 5B, a different transaction 88 is performed with a different credit card, but at the same merchant 84. In this case, a different in-game reward 94 is provided, because a different credit card was used. In a different implementation, the same in-game reward may be provided. For example, the user may configure the system such that any transaction leads to in-game currency being provided as a reward.

In FIG. 5C, yet another transaction 96 is performed with the same (first) credit card at the first merchant, but in this case, the transaction is performed for a first good. This transaction 96 leads to an in-game reward 102 being provided. In FIG. 5D, yet another transaction 104 is illustrated, with the same credit card used above, but for a different good (at the same merchant 84). The transaction 104 leads to a different in-game reward 108 being provided, because a different good was purchased as compared to that of the transaction 96.

In FIG. 5E, another transaction 112 is performed, with the same credit card, and for the same good as purchased in FIG. 5C. In this case, the transaction 112 is conducted at a different merchant 114. The transaction 112 leads to a different in-game reward 116 being provided to the user, even though the same credit card was used to purchase the same good. The difference is caused (in this example) by the different merchants being accessed by the transaction. Clearly numerous variations of these associations will be understood given this teaching.

Figure 6:
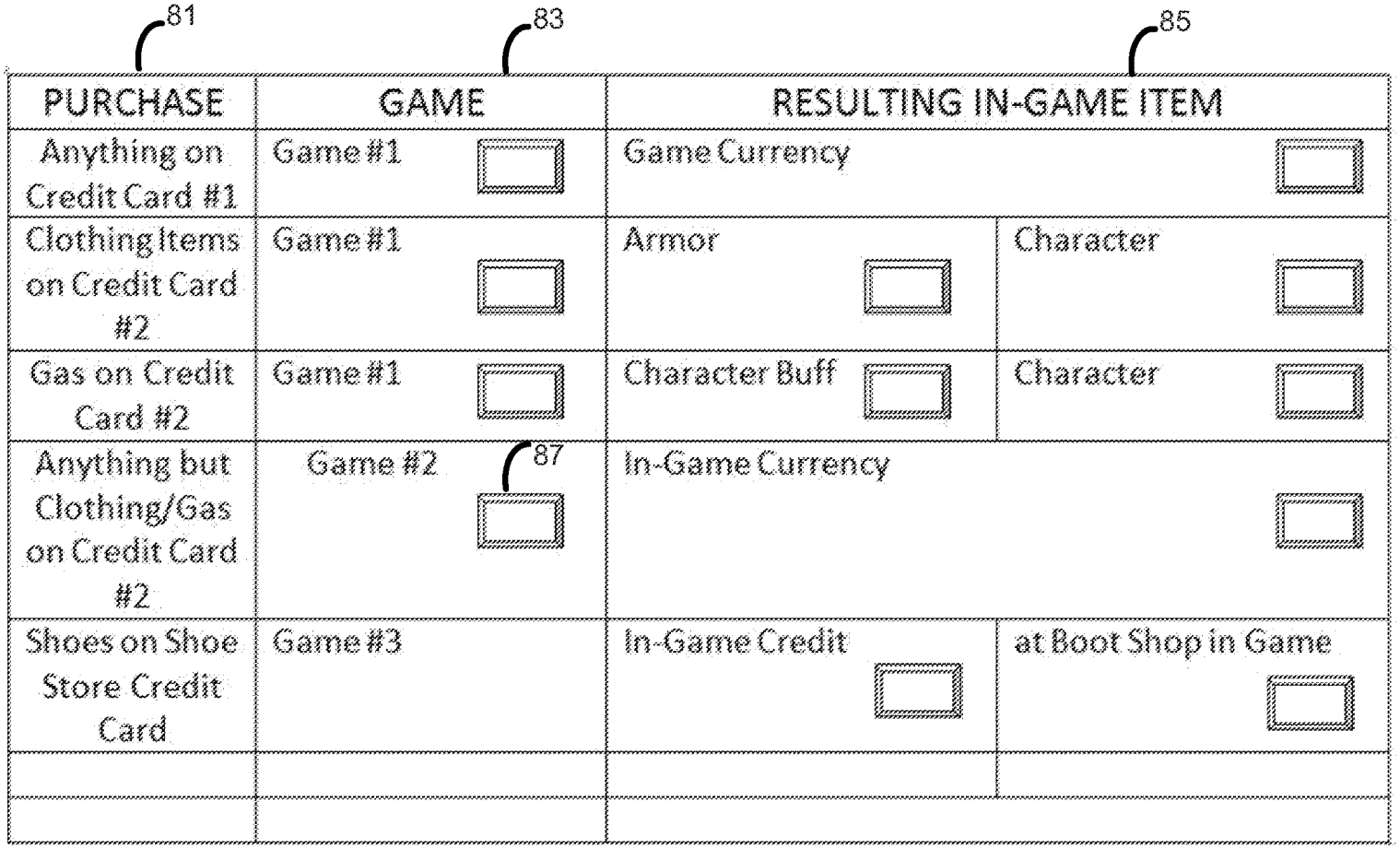
FIG. 6 is an exemplary user interface by which a user may associate specific credit or debit cards, or categories of purchases, with specific games and/or in-game items.

A user interface may be provided by which a user can associate different merchants or different categories of transactions with different games or in-game items, and such is illustrated by the exemplary user interface 50 of FIG. 6. In the exemplary user interface 50, a first column 81 denotes a type of purchase, and a user may be enabled to associate particular categories of transactions, or particular credit or debit cards, with specific in-game benefits. The specific in-game benefits may be localized by game using selections in column 83, and may be further localized using column 85 to a specific type of item within the game selected in column 83. For example, in the first row, any transactions using credit card #1 lead to game currency being provided in game #1. In the second row, clothing items purchased on credit card #2 lead to specific benefits within game #1, the specific benefits being armor for a particular character.

Continuing to the third row, gas purchased on credit card #2 provides a further benefit within game #1, the benefit being a character buff to a particular character. In the fourth row, if anything other than clothing or gas is purchased on credit card #2, an in-game benefit is provided within game #2, the in-game benefit being in-game currency. Finally, in the fifth row, if shoes are purchased on a shoe store credit card, the applicable loyalty program may lead to a benefit in a game #3, the benefit being in-game credit at a selected boot shop within the game.

While certain exemplary buttons 87 are illustrated, which result in drop-down menus for the various choices for selections within a cell of the user interface, it will be understood that generally any of the cells may be enabled to have buttons which when activated lead to drop-down menus or other selection mechanisms. It will also be understood given this teaching that variations of such user interfaces are possible.

Figure 7:
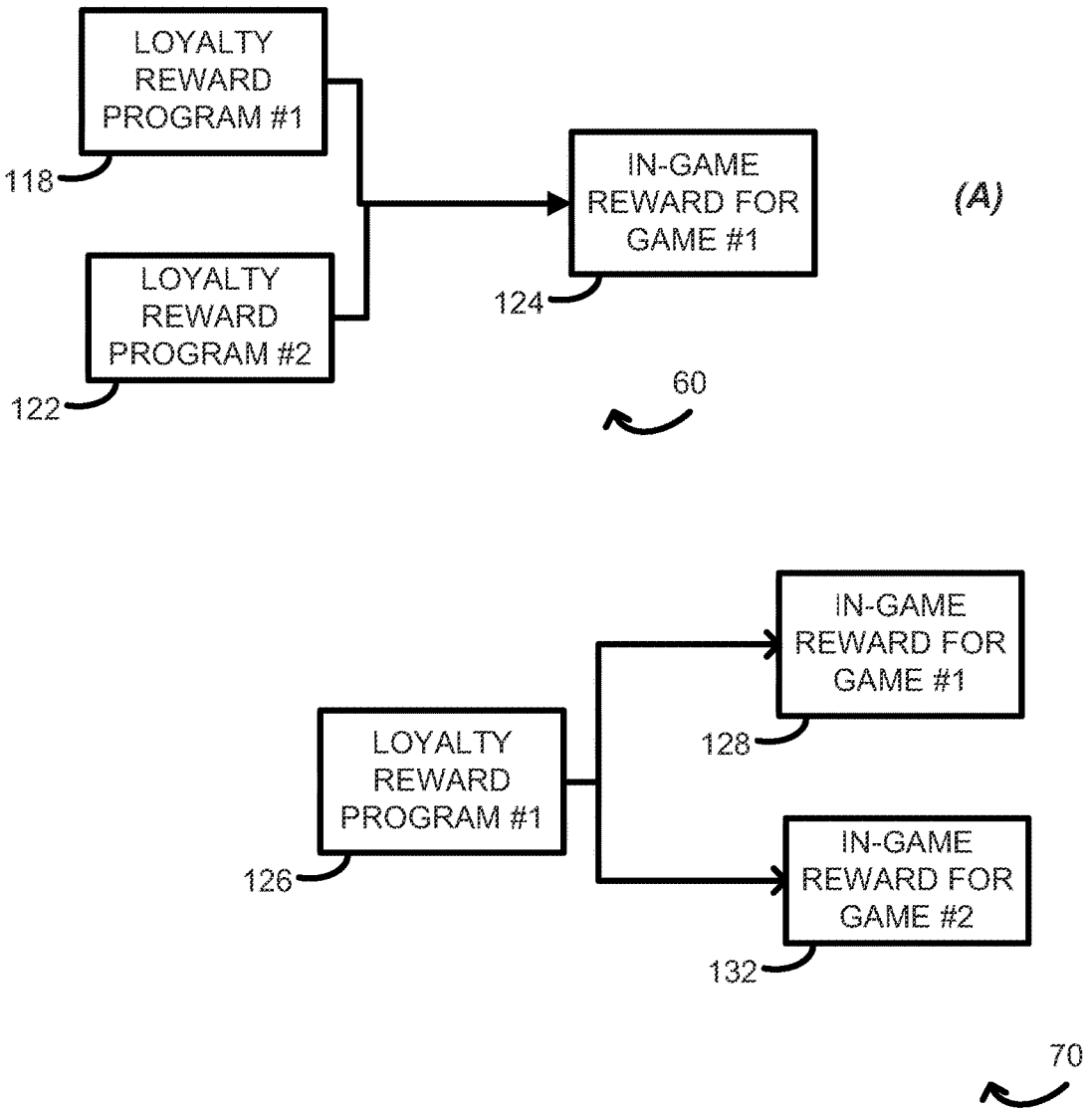
FIGS. 7(A)-7(B) illustrate how systems and methods according to present principles may be employed with multiple loyalty reward programs, and how a single loyalty reward program may be employed with multiple games.

FIGS. 7A and 7B illustrate additional flexibility provided by systems and methods according to present principles. In the flowchart 60 of FIG. 7A, it is seen that a first loyalty reward program 118 and a second loyalty reward program 122 may lead to in-game rewards for the same game 124. Conversely, in the flowchart 70 of FIG. 7B, it is seen that a common loyalty reward program 126 may lead to in-game rewards being provided within a first game 128 and a second game 132. The distribution between the first and second game may be set by the user, e.g., using a similar sort of user interface as in FIG. 6, but where an apportionment percentage is enabled to be set for different games for transactions within a common loyalty program.

Figure 8:
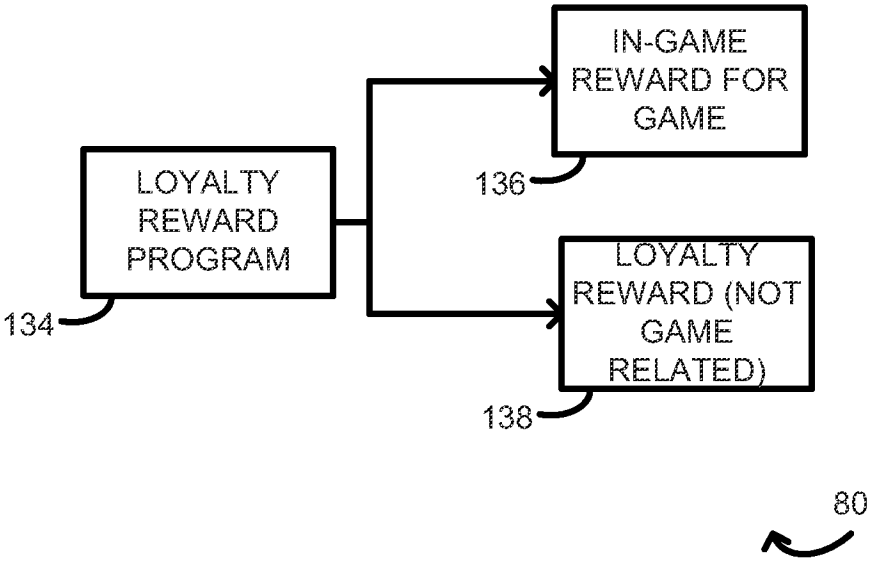
FIG. 8 illustrates how, according to present principles, a loyalty reward program may result in an in-game reward as well as a loyalty reward.

FIG. 8 illustrates additional flexibility options provided by systems and methods according to present principles. In the flowchart 80, a loyalty reward program 134 is shown as leading to an in-game reward 136 as described above. In addition to leading to an in-game reward 136, the loyalty reward program 134 may also lead to a non-game related loyalty reward 138 being provided. In other words, the loyalty reward program can be partially used for in-game benefits and partially used for out-of-game benefits as above. The distribution may be set by the user, e.g., using a similar sort of user interface as in FIG. 6, but where an apportionment percentage is enabled to be set. The apportionment percentage may be replaced with other options, such as a cap on the amount of loyalty points usable for in-game rewards, or any other apportionment method desired by the user.

Figure 9:
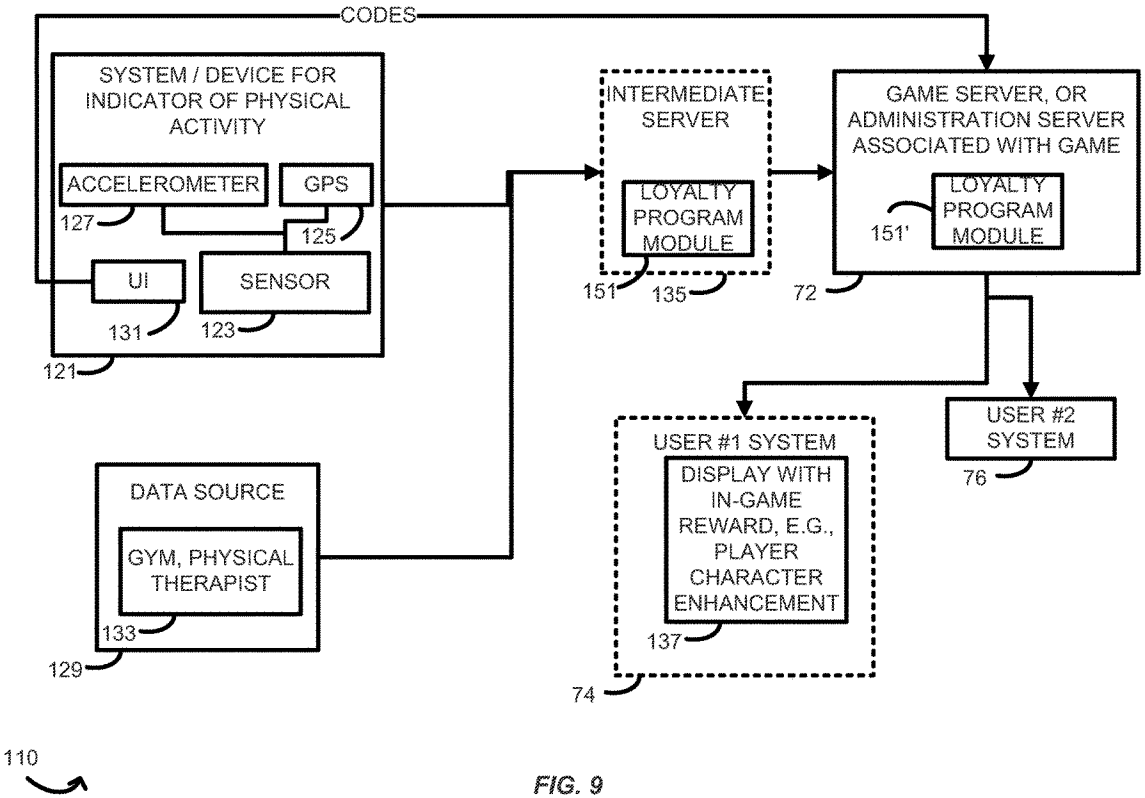
FIG. 9 is a logical diagram illustrating components in an exemplary system and method according to present principles.

FIG. 9 illustrates a logical diagram 110 which shows another way in which a user can gain benefits in game. In this implementation, user activity, which may in many cases be related to a user's physical activity, provides in-game benefits and thus provides an incentive for user activity, e.g., participation in fitness or health regimes and/or weight loss or the like. In this way, users may be incentivized to reach fitness or other goals.

In these systems, game play benefits may be based on tracked physical activity. For example, receiving in-game benefits, advancements, and rewards may correspond to physical activity performed, and/or may correspond to the physical performance of the user in the real world.

In one implementation, a system or device 121 that measures or provides an indicator of physical activity is employed. The system or device 121 provides a way in which a game may obtain information about user activity. In one example, the system or device 121 may include a sensor 123 that senses physical activity. Such a sensor 123 may include a GPS system 125, an accelerometer 127, or the like. The accelerometer 127 may in one implementation be conveniently located or disposed on a mobile device such as a smart phone. The sensor 123 may also be a sensor coupled to an exercise machine, e.g., a treadmill or stationary bike, e.g., one located in a gym or at the user's home. The sensor 123 may also be a sensor coupled to a scale, heart rate monitor, blood pressure monitor, or the like.

Another indicator of physical activity may include a data source 129. The data source 129 may receive data from a source 133 such as a gym, physical therapist, doctor, or the like. For example, a gym may report a number of times a user has worked out, which data may be made even more granular by tracking the number of hours a user has worked out. The gym may report how much a user can lift, and the same may be used to provide a player character strength enhancement, increase in stamina, increase in health or hit points, or the like. Spending time in the gym may further cause a user to accumulate credits in game. If the credits are used for healing, for example, then the reward would be correlated. If the credits are used for other things, e.g., purchasing weapons or recruiting followers, the in-game rewards may be uncorrelated to the real world activity.

A user that achieves a weight-loss goal in the real world may be rewarded in the game in a variety of ways. Some of those ways, such as additional stamina, hit points, or health, would be correlated to the weight-loss in the real world, and may lead to an increase in the character's overall strength. Other rewards may be uncorrelated, such as gaining access to more hints in a strategy or puzzle game.

As another example, the system or device 121 may include a user interface 131 to receive user input. That is, in some instances, the user's physical activity may be self-reported to the game by a user input.

Information about user activity may be communicated to the game server (or game administration server) 72 in a number of ways. In one implementation, the system or device may issue codes which a user may then input into the game using the UI 131 to receive one or more corresponding benefits. For example, if the system or device 121 is implemented as an application within a mobile device, the application may issue the codes. In some cases, an exercise machine may be enabled to issue codes, either for a specific user selected game, or a code that may be entered in a clearinghouse website, and by user selection within the clearinghouse website, a particular game account or player character may be provided the benefit. The data source 129 may also issue such codes. In these ways, codes may be given directly to the game to gain the in-game benefits with no server communication needed.

Where codes are not employed, the system or device 121 may provide data to the server 72 resulting in the benefit to the user game account or player character. The data source 129 may also provide such data. In these implementations, the system or device 121 tracking the user's activity can communicate with the game system so that the user need not enter a code nor arrange for server communication. However, in some instances, an intermediate server 135 may be provided to act as a repository for data about user activity prior to forwarding the same on to the game server 72. For example, the intermediate server 135 may act as a collection point for multiple sources of user activity data. Where an intermediate server 135 is employed, the game server 72 may access the reported information from the intermediate server and may modify game play accordingly. In other instances, the intermediate server 135 may determine the game play changes that should be made based on the reported activity. Generally, however, the intermediate server may send summary information about the user's activities to the game server, as generally the game server need not be informed of low-level user activities, e.g., an individual performance of a single treadmill "run" at a health club (although such granular reporting is encompassed by present principles).

A loyalty program module 151 or 151' may be employed which contains the logic used to determine what benefit to grant based on the user's activities. The loyalty program module may be resident on the intermediate server 135, the game server 72, or elsewhere, e.g., on a server associated with a merchant or the loyalty program administrator. In some cases the loyalty program module may communicate transaction activity to the game administration server which then makes decisions as to what in-game benefits should be granted based on those transactions. In other cases the loyalty program module determines the benefits.

Once the game has received such data, a first user system 74 may display such an in-game benefit 137, e.g., character enhancement, by rendering the same on a display as noted above in connection with FIG. 4.

Figure 10:
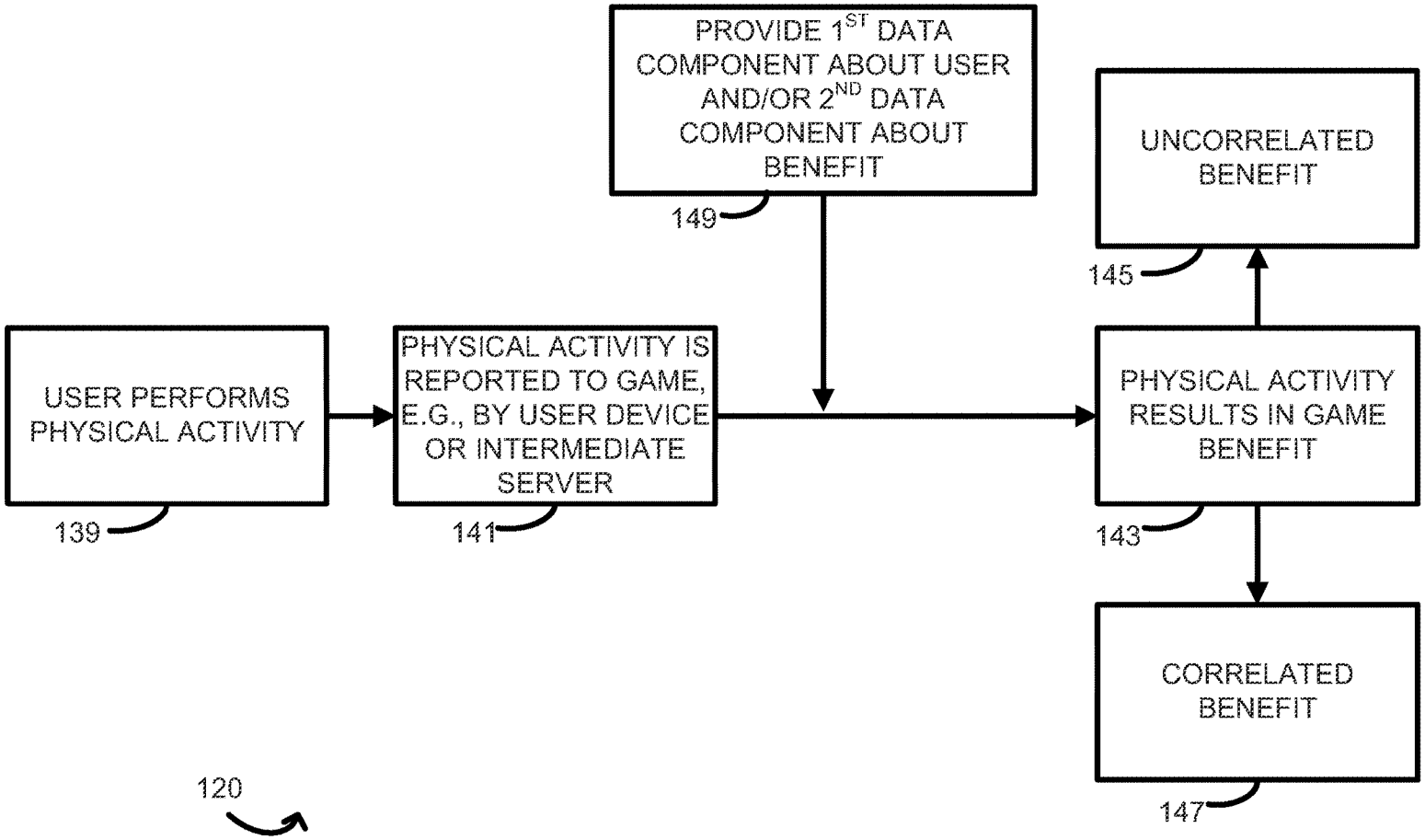
FIG. 10 is a flowchart illustrating another method according to present principles, illustrating an exemplary technique to receive in-game rewards from a user activity.

FIG. 10 is a flowchart 120 of a method which may implement the system of FIG. 9. In a first step, a user performs an activity such as a physical activity (step 139). The physical activity is then reported to the game (step 141), e.g., either directly by the device which measured the physical activity or through an intermediary. For example, an exercise machine may report the activity to a game server, either directly or through an intermediate server.

An application running on a smart phone monitoring user activity may also report the same to the game server either directly or through an intermediate server. Another way physical activity may be reported to the game is by the device or system monitoring such activity to issue a code which may be entered by the user into the game directly. Gyms, doctors, and other data sources may also provide such codes.

The information provided (step 149) to the game server may include a first data component identifying the user and/or a second data component about the benefit to be associated with the user, e.g., including information about a particular player character to benefit from the physical activity.

The physical activity then results in a game benefit (step 143). The game benefit may be uncorrelated to the physical activity (step 145), or the game benefit may be correlated to the same (step 147). For example, data about a user's physical prowess may result in an enhancement to a player character's strength, hit points, stamina, or the like. The in-game benefit may be determined by the intermediate server or by the game server. The in-game benefit may also be determined by the user, using a similar sort of user interface as disclosed above in connection with FIG. 6. In this way, the user can choose their own in-game benefits. For example, a benefit based on an increase in a user's fitness may lead to an in-game benefit which is selected by the user to be either related to dexterity or strength. The user may be given the option to choose the benefit or the system may determine the benefit (or a default option).

It will be understood that other implementations are also possible. For example, students who reach particular academic goals, e.g., good grades, may be provided codes to enter in a game which increase a player character's intelligence or other mental acumen characteristic. Other real world physical activities can be measured and correlated to in-game advancements or enhancements, including go-kart driving, laser tag, paintball, or the like. The real world activity could also include participation in sports leagues, such as softball, tennis, pool, or bowling.

In another particular implementation, a user's running speed may be tracked in the real world. As the user runs faster, the speed their character can run in-game also increases. Such data may be obtained from timing data from races, and the user may provide game account information when they register for a race, such as a token or account ID. The race organizer can report the user's results and the user can obtain credit for those results the next time they play the game.

In another use case, a user's ability to throw or shoot accurately may affect their ability to aim accurately in game. For example, doing better in a darts tournament, or on a shooting range, can allow an in-game character to aim better.

As another example, a user's real world bowling can be measured so that their in-game character is more likely to throw the ball in a way similar to how the user bowls in real life. A user who throws a discus or shotput farther in real life can cause their in-game player character to throw farther as well.

What has been disclosed are systems and methods for providing in-game benefits based on transactions associated with a loyalty program or on other user activity, including user physical activity. Other variations are also possible and will be readily apparent to those of skill in the art in light of this new disclosure. For example, in-game rewards may be based on stock transactions, real estate transactions, or virtually any other sort of transaction. Game servers, or game administration servers, rather than being notified by loyalty program servers or credit card processing bank servers, may also be notified by merchant bank servers, or other bank servers with which users may have accounts. Game servers may also be notified by financial processing or recordkeeping software, even consumer-based financial processing or recordkeeping software, which may send a signal to a game server upon detection of a transaction which may lead to an in-game benefit, the detection occurring upon downloading of the transaction into the financial processing or recordkeeping software. Points associated with loyalty programs, i.e., loyalty points, may be generic and associated with, e.g., a credit card, or specific to a game, e.g., game-associated loyalty points. For example, a credit card may be associated with a loyalty program for the game Everquest Next® from Sony Online Entertainment LLC, and transactions on the credit card may then result in game loyalty points for potential expenditure within that game.

It should also be noted that the term "real world" as used in the context of certain transactions with respect to a game may generally relate to transactions or actions that are not performed or completed within the game. Such transactions may include those completed outside of the game but within a different game. For example, obtaining a trophy or achievement in one game may constitute a real world transaction with respect to a (different) subject game. Moreover, many activities which are virtual in the sense of occurring online may still be 'real world' in the context of a subject game, such as online shopping, taking part in surveys, voting, social network usage, and the like.

One implementation includes one or more programmable processors and corresponding computer system components to store and execute computer instructions and data, such as to provide the structures, systems, and interfaces to provide the in-game benefits for loyalty rewards system described above, as well as the bank, merchant, and purchaser systems. One such computing environment is disclosed below.

Figure 11:
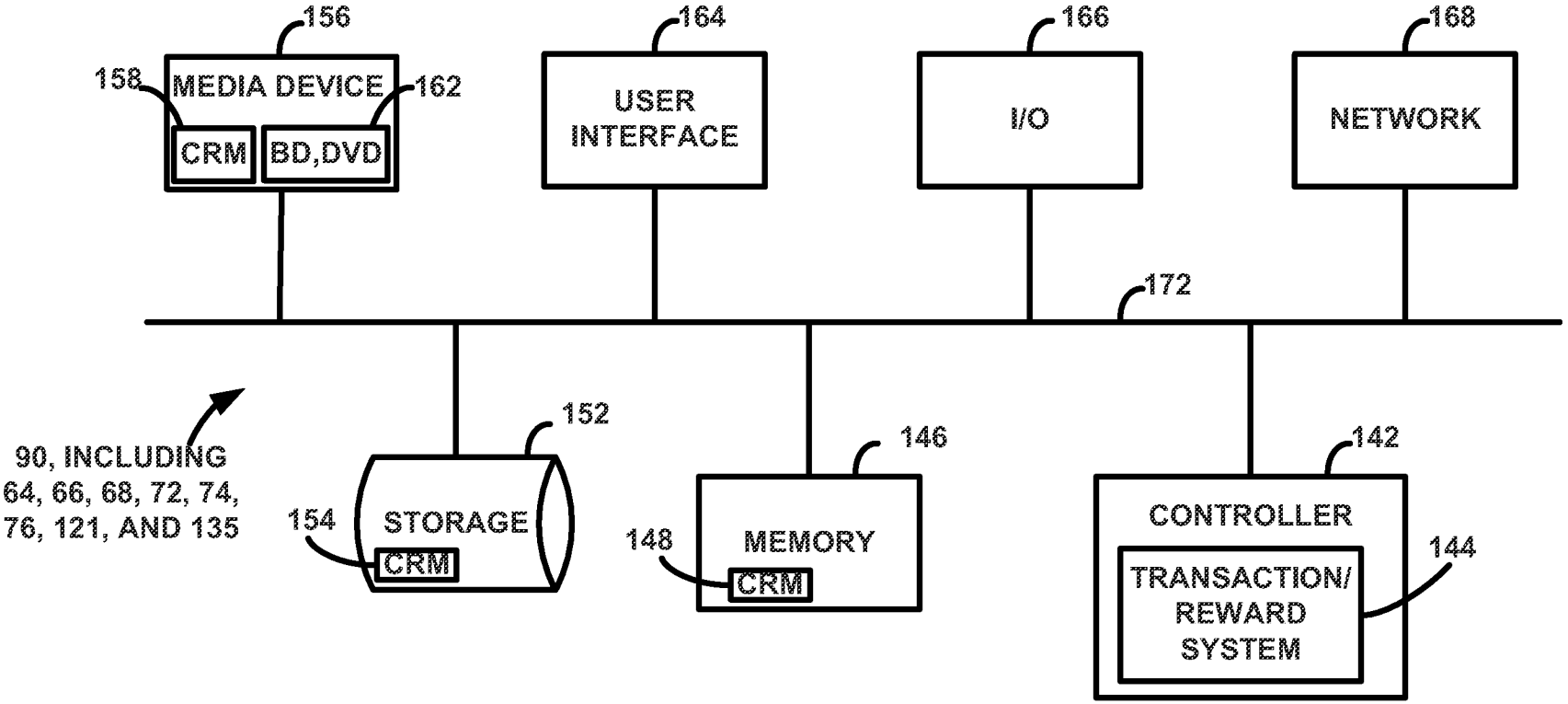
FIG. 11 is an exemplary computing environment in which the methods according to present principles may be implemented.

Referring to FIG. 11, a representation of an exemplary computing environment 90 in which the system and method may be implemented is illustrated.

The computing environment 90 includes a controller 142, a memory 146, storage 152, a media device 156, a user interface 164, an input/output (I/O) interface 166, and a network interface 168. The components are interconnected by a common bus 172. Alternatively, different connection configurations can be used, such as a star pattern with the controller at the center.

The controller 142 includes a programmable processor and controls the operation of a transaction/reward system 144. The controller 142 loads instructions from the memory 146 or an embedded controller memory (not shown) and executes these instructions to control the system.

Memory 146, which may include non-transitory computer-readable memory 148, stores data temporarily for use by the other components of the system. In one implementation, the memory 146 is implemented as DRAM. In other implementations, the memory 146 also includes long-term or permanent memory, such as flash memory and/or ROM.

Storage 152, which may include non-transitory computer-readable memory 154, stores data temporarily or long-term for use by other components of the system, such as for storing data or instructions. In one implementation, the storage 152 is a hard disc drive, a solid state drive, or cloud storage.

The media device 156, which may include non-transitory computer-readable memory 158, receives removable media and reads and/or writes data to the inserted media. In one implementation, the media device 158 is an optical disc drive or disc burner, e.g., a writable Blu-Ray® disc drive 162.

The user interface 164 includes components for accepting user input, e.g., the user indication of in-game rewards desired for loyalty programs or other aspects discussed above, and presenting a display, e.g., the user interface noted above, to the user. In one implementation, the user interface 164 includes a keyboard, a mouse, audio speakers, and a display. The controller 156 uses inputs entered by the user to adjust the operation of the computing environment.

The I/O interface 166 includes one or more I/O ports to connect to corresponding I/O devices, such as external storage or supplemental devices, e.g., a printer or a PDA. In one implementation, the ports of the I/O interface 166 include ports such as: USB ports, PCMCIA ports, serial ports, and/or parallel ports. In another implementation, the I/O interface 166 includes a wireless interface for wireless communication with external devices.

The network interface 168 allows connections with the local network and includes a wired and/or wireless network connection, such as an RJ-45 or Ethernet connection or Wi-Fi interface (802.11). Numerous other types of network connections will be understood to be possible, including WiMax, 3G or 4G, 802.15 protocols, 802.16 protocols, satellite, Bluetooth®, or the like.

The system may include additional hardware and software typical of such devices, e.g., power and operating systems, though these components are not specifically shown in the figure for simplicity. In other implementations, different configurations of the devices can be used, e.g., different bus or storage configurations or a multi-processor configuration.

The methods shown and described above may be implemented in one or more general, multi-purpose, or single-purpose processors. Unless specifically stated, the methods described herein are not constrained to a particular order or sequence. In addition, some of the described methods or elements thereof can occur or be performed concurrently.

Functions/components described herein as being computer programs are not limited to implementation by any specific embodiments of computer programs. Rather, such functions/components are processes that convey or transform data, and may generally be implemented by, or executed in, hardware, software, firmware, or any combination thereof.

It will be appreciated that particular configurations of the operating environment may include fewer, more, or different components or functions than those described. In addition, functional components of the operating environment may be implemented by one or more devices, which are co-located or remotely located, in a variety of ways.

For example, the system and method may be fully implemented in any number of computing devices. Typically, instructions are laid out on computer readable media, generally non-transitory, and these instructions are sufficient to allow a processor in the computing device to implement the method of the invention. The computer readable medium may be a hard drive or solid state storage having instructions that, when run, are loaded into random access memory. Inputs to the application, e.g., from the plurality of users or from any one user, may be by any number of appropriate computer input devices. For example, users may employ a keyboard, mouse, touchscreen, joystick, trackpad, other pointing device, or any other such computer input device to input data relevant to the calculations. Data may also be input by way of an inserted memory chip, hard drive, flash drives, flash memory, optical media, magnetic media, or any other type of file—storing medium. The outputs may be delivered to a user by way of a video graphics card or integrated graphics chipset coupled to a display that may be seen by a user. Alternatively, a printer may be employed to output hard copies of the results. Given this teaching, any number of other tangible outputs will also be understood to be contemplated by the invention. For example, outputs may be stored on a memory chip, hard drive, flash drives, flash memory, optical media, magnetic media, or any other type of output. It should also be noted that the invention may be implemented on any number of different types of computing devices, e.g., personal computers, laptop computers, notebook computers, net book computers, handheld computers, personal digital assistants, mobile phones, smart phones, tablet computers, and also on devices specifically designed for these purpose. In one implementation, a user of a smart phone or wi-fi—connected device downloads a copy of the application to their device from a server using a wireless Internet connection. An appropriate authentication procedure and secure transaction process may provide for payment to be made to the seller. The application may download over the mobile connection, or over the WiFi or other wireless network connection. The application may then be run by the user. Such a networked system may provide a suitable computing environment for an implementation in which a plurality of users provide separate inputs to the system and method. In the below system wherein-game rewards are contemplated, the plural inputs may allow plural users to input relevant data at the same time.

Although the subject matter herein has been described in language specific to structural features and/or methodological acts, it is also to be understood that the subject matter defined in the claims is not necessarily limited to the specific features or acts described above. Rather, the specific features and acts described above are disclosed as example forms of implementing the claims.

It will further be understood that when one element is indicated as being responsive to another element, the elements may be directly or indirectly coupled. Connections depicted herein may be logical or physical in practice to achieve a coupling or communicative interface between elements. Connections may be implemented, among other ways, as inter-process communications among software processes, or inter-machine communications among networked computers.

The word "exemplary" is used herein to mean serving as an example, instance, or illustration. Any implementation or aspect thereof described herein as "exemplary" is not necessarily to be construed as preferred or advantageous over other implementations or aspects thereof.

As it is understood that embodiments other than the specific embodiments described above may be devised without departing from the spirit and scope of the appended claims, it is intended that the scope of the subject matter herein will be governed by the following claims.

The invention claimed is:

1. A method for providing an in-game benefit based on a transaction associated with a loyalty program, comprising:

a. at a controller, receiving a signal corresponding to a transaction associated with a loyalty program account; and b. corresponding to the received signal, transmitting data from the controller to a game server or a game administration server running or administering a game, respectively, the data including at least:

i. a first data component including identifying information about a game account associated with the loyalty program account, the game account associated with the game; and ii. a second data component including at least information about the transaction, wherein the second data component further includes at least identifying information about a player character associated with the game account; and c. rendering an indication of the in-game benefit on a display, the in-game benefit based on the second data component, the rendering occurring in the game, the in-game benefit being a change to a player character parameter or player character inventory item associated with the player character.

2. The method of claim 1, wherein the receiving and transmitting are performed on a loyalty program module.

3. The method of claim 2, wherein the loyalty program module is resident on an intermediate server.

4. The method of claim 1, wherein the loyalty program account is associated with the game.

5. The method of claim 1, wherein the second data component further includes information about an in-game benefit to be associated with the game account based on the transaction.

6. The method of claim 1, wherein the game server or game administration server is configured to determine an in-game benefit for the game account at least partially based on the second data component.

7. The method of claim 1, wherein the identifying information about a player character includes data about a player character parameter or player character inventory item to be benefited by the in-game benefit.

8. The method of claim 1, wherein the player character is made stronger by the in-game benefit, or wherein the player character receives an in-game item by the in-game benefit.

9. The method of claim 1, wherein the second data component further includes at least identifying information about the game associated with the game account.

10. The method of claim 9, wherein the second data component further comprises an amount of in-game currency to be associated with the game account.

11. The method of claim 1, wherein the transaction is associated with more than one loyalty program.

12. The method of claim 1, wherein the transaction is associated with a credit card, a debit card, or a loyalty card.

13. The method of claim 1, wherein the transmitting data includes transmitting data from a credit or debit card processing server.

14. The method of claim 13, wherein the credit card processing server is a bank server or a merchant server.

15. The method of claim 1, wherein the transmitting data includes transmitting data from a server associated with a loyalty program.

16. A non-transitory computer readable medium, comprising instructions for causing a computing environment to perform the method of claim 1.

17. The method of claim 1, further comprising instantiating a user interface application, the user interface application performing the following steps:

a. displaying indicators of one or more of the loyalty program accounts;

b. displaying one or more of the game accounts to be associated with the one or more of the loyalty program accounts;

c. receiving a first input from a user, the first input associating one of the displayed game accounts with one of the loyalty programs; and d. displaying an indication of the associated game account and loyalty program.

18. The application of claim 17, further comprising receiving a second input from a user, the second input associating a player character within a game within the associated game account with the loyalty program.

19. The application of claim 18, further comprising receiving a third input from a user, the third input associating a parameter of the player character with the loyalty program.

20. The application of claim 19, wherein the parameter is a player character characteristic or a player character inventory.

21. A non-transitory computer readable medium, comprising instructions for causing a computing environment to perform the method of claim 17.

22. The method of claim 1, further comprising automatically providing an in-game benefit based on the transaction.

23. The method of claim 22, wherein the in-game benefit is automatically provided to a predetermined game within the game account.

24. The method of claim 23, wherein the in-game benefit is automatically provided to a predetermined player character within the predetermined game within the game account.

25. The method of claim 1, further comprising:

a. following the receiving a signal corresponding to a notification of a transaction associated with a loyalty program;

b. adding a number of loyalty points based on the transaction to a loyalty program account associated with the loyalty program;

c. receiving an indication from a user of a game account on which to expend a number of loyalty points; and d. transmitting the data to the game server or the game administration server associated with the indicated game account, wherein the second data component includes at least information about the number of loyalty points.

26. The method of claim 25, wherein the transmitted data further provides data to the game server or the game administration server about an in-game benefit to be purchased with the loyalty points.

27. A method for providing an in-game benefit based on user activity, comprising:

a. monitoring user physical activity using an application on a smart phone, the monitored user activity measured by a sensor coupled to an exercise machine or by an accelerometer or GPS system in the smart phone; and b. transmitting data from the smart phone to a game server or a game administration server, the data including at least:

i. a first data component including identifying information about a game account and further comprising data about a game associated with the game account to which an in-game benefit is to be provided and data about a character within the game associated with the game account to which the in-game benefit is to be provided; and ii. a second data component including at least information about the monitored physical activity, wherein the in-game benefit to be associated with the player character is correlated to the monitored user physical activity.

28. A non-transitory computer readable medium, comprising instructions for causing a computing environment to perform the method of claim 27.

* * * * *